US011345987B2

(12) United States Patent
Cheng et al.

(10) Patent No.: US 11,345,987 B2
(45) Date of Patent: May 31, 2022

(54) METAL MATERIAL HYDROPHOBIC SURFACE TREATMENT METHODS

(71) Applicant: Robert Bosch GmbH, Stuttgart (DE)

(72) Inventors: Lei Cheng, Sunnyvale, CA (US); Soo Kim, Cambridge, MA (US); Mordechai Kornbluth, Brighton, MA (US); Jonathan Mailoa, Cambridge, MA (US); Georgy Samsonidze, San Francisco, CA (US); Nathan Craig, Sunnyvale, CA (US); Christina Johnston, Sunnyvale, CA (US)

(73) Assignee: Robert Bosch GmbH, Stuttgart (DE)

( * ) Notice: Subject to any disclaimer, the term of this patent is extended or adjusted under 35 U.S.C. 154(b) by 510 days.

(21) Appl. No.: 16/229,199

(22) Filed: Dec. 21, 2018

(65) Prior Publication Data

US 2020/0199731 A1 Jun. 25, 2020

(51) Int. Cl.

| | |
|---|---|
| ***C23C 8/02*** | (2006.01) |
| ***C23C 22/34*** | (2006.01) |
| ***C23C 8/40*** | (2006.01) |
| ***C21D 6/00*** | (2006.01) |
| *C23C 8/80* | (2006.01) |
| *C22C 38/02* | (2006.01) |
| *C22C 38/44* | (2006.01) |

(52) U.S. Cl.

CPC ..... *C23C 8/40* (2013.01); *C21D 6/004* (2013.01); *C21D 6/005* (2013.01); *C23C 8/02* (2013.01); *C22C 38/02* (2013.01); *C22C 38/44* (2013.01)

(58) Field of Classification Search

CPC ..... C21D 6/004; C21D 6/005; C22C 38/02; C22C 38/44; C23C 8/02; C23C 8/10; C23C 8/34; C23C 8/36; C23C 8/40; C23C 8/60

See application file for complete search history.

(56) References Cited

U.S. PATENT DOCUMENTS

| | | | | |
|---|---|---|---|---|
| 5,009,963 | A | 4/1991 | Ohmi et al. | |
| 6,280,597 | B1 | 8/2001 | Kashiwada et al. | |
| 9,451,130 | B2 | 9/2016 | Sakai et al. | |
| 2009/0324834 | A1* | 12/2009 | Hanson | C23C 22/05 427/327 |

FOREIGN PATENT DOCUMENTS

| | | | |
|---|---|---|---|
| CN | 107815679 | A | 3/2018 |

OTHER PUBLICATIONS

Latifi et al., Plasma surface oxidation of 316L stainless steel for improving adhesion strength of silicone rubber coating to metal substrate, Applied Surface Science, Sep. 22, 2014, pp. 471-481, Iran, 11 pages.

* cited by examiner

*Primary Examiner* — Lois L Zheng

(74) *Attorney, Agent, or Firm* — Brooks Kushman P.C.

(57) ABSTRACT

A method for treating a metal material to make a surface portion hydrophobic. The method includes oxidizing an untreated surface portion of the metal material to form an oxidized surface portion. The untreated surface portion has metal atoms. The oxidizing step forming bonds between the metal atoms and oxygen atoms. The method further includes doping the oxidized surface portion with a liquid containing a fluorine-containing salt to form a fluorinated surface portion. The doping step forming bonds between fluorine atoms and at least a portion of the metal atoms and the oxygen atoms. The fluorinated surface portion is hydrophobic.

20 Claims, 3 Drawing Sheets

METAL MATERIAL HYDROPHOBIC SURFACE TREATMENT METHODS

TECHNICAL FIELD

The present disclosure relates to metal material hydrophobic surface treatment methods and metal material hydrophobic surfaces related thereto, and in some embodiments, methods for treating stainless steel alloys to impart hydrophobic surface characteristics.

BACKGROUND

Certain metals materials (e.g., elemental metals and metal alloys) are suitable for a wide number of applications due to their mechanical strength and corrosion resistance. One family of non-limiting examples are stainless steel alloys. Stainless steel alloys have wide application in the fields of the food industry, water purification, construction, maritime and aviation. In many of these applications, water contacting the surface of the stainless steel alloy is common. The water contact may cause material or device degradation (e.g., corrosion issues). Accordingly, it may be particularly useful to impart hydrophobic properties to the stainless steel alloy (or other metal material) to enhance corrosion resistance and other properties, such as, anti-bio-fouling, anti-icing, and self-cleaning.

SUMMARY

According to one embodiment, a method for treating a metal material is disclosed. The method includes oxidizing an untreated surface portion of the metal material to form an oxidized surface portion. The untreated surface portion has metal atoms. The oxidizing step forms bonds between the metal atoms and oxygen atoms. The method further includes the step of doping the oxidized surface portion with a liquid containing a fluorine-containing salt to form a fluorinated surface portion. The doping step forms bonds between fluorine atoms and at least a portion of the metal atoms and the oxygen atoms. The fluorinated surface portion is hydrophobic.

According to another embodiment, a method for treating a metal material is disclosed. The method includes selecting a depth of an untreated surface portion of the metal material based on a threshold concentration of a metal material combination including chromium atoms and nickel atoms in the untreated surface portion. The method further includes oxidizing the untreated surface portion to form an oxidized surface portion by forming bonds between at least a portion of the chromium atoms and nickel atoms in the metal material combination and oxygen atoms. The method also includes doping the oxidized surface portion with a liquid containing a fluorine-containing salt to form a fluorinated surface portion. The doping step forms bonds between fluorine atoms and at least a portion of the chromium atoms and the nickel atoms in the metal material combination and the oxygen atoms. The fluorinated surface portion is hydrophobic.

In another embodiment, a hydrophobic metal material is disclosed. The hydrophobic metal material includes a surface region and a bulk region. The surface region has greater than or equal to a threshold concentration of chromium atoms and nickel atoms. The bulk region has less than the threshold concentration of the chromium atoms and nickel atoms. At least a first portion of the chromium atoms and nickel atoms of the surface region are bonded to oxygen atoms. At least a second portion of the chromium atoms, nickel atoms, and oxygen atoms are bonded to fluorine atoms such that the surface region is hydrophobic.

DETAILED DESCRIPTION

Figure 1:
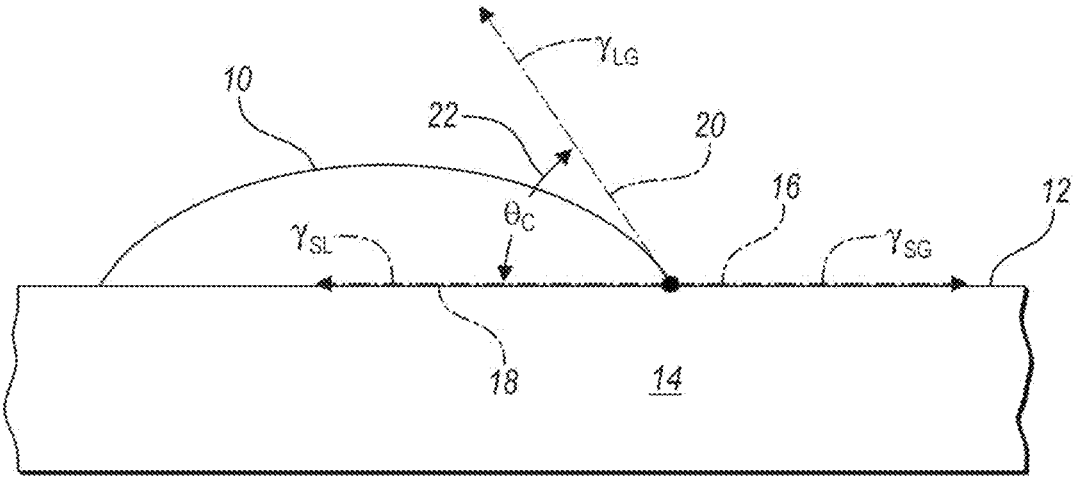
FIG. 1 is a schematic side view of a water droplet on a surface depicting the quantities of the Young Equation.

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of," and ratio values are by weight; the term "polymer" includes "oligomer," "copolymer," "terpolymer," and the like; the description of a group or class of materials as suitable or preferred for a given purpose in connection with the invention implies that mixtures of any two or more of the members of the group or class are equally suitable or preferred; molecular weights provided for any polymers refers to number average molecular weight; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

This invention is not limited to the specific embodiments and methods described below, as specific components and/or conditions may, of course, vary. Furthermore, the terminology used herein is used only for the purpose of describing particular embodiments of the present invention and is not intended to be limiting in any way.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within +0%, 0.1%, 0.5%, 1%, 2%, 3%, 4%, 5% or 10% of the value or relative characteristic.

Stainless steel alloys can be used in a wide range of applications. In many applications, it is particularly useful to impart hydrophobic properties to the surface of the stainless steel alloy to enhance the corrosion resistance of the stainless steel alloy. Conventional surface modification processes exist to prepare stainless steel alloys including a surface with hydrophobic properties. These processes include laser ablation and chemical coating. Laser ablation methods create a surface microstructure with wetting properties of a hydrophobic surface. A chemical coating can be applied to a surface of a stainless steel alloy to impart hydrophobic properties.

These conventional processes suffer from certain drawbacks and disadvantages. The surface microstructure of a laser ablated surface may not have the durability necessary for many of the applications identified above. Moreover, laser ablation processes are not scalable for many industrial applications due to expense and processing time. The chemical coatings often lack mechanical durability for long-term use. Furthermore, fluoropolymer chemicals are typically used as the chemical coating. The use of fluoropolymer chemicals is widely regulated, and in some instances, some fluoropolymer chemicals may not be used in certain applications because of the regulations.

In light of the foregoing, what is needed is a method for treating a surface of a metal material, such as a stainless steel alloy, to provide hydrophobicity to the surface. In one or more embodiments, the method is scalable and results in a treated metal material that has mechanical and chemical durability.

In one embodiment, a stainless steel alloy is treated in a two-step method to impart hydrophobicity to a surface portion of the stainless steel alloy. A stainless steel alloy may include iron, chromium, oxygen, and a maximum amount of carbon. The percentage by weight of iron in the stainless steel alloy may be any one of the following values or within a range of any two of the following values: 60, 65, 70, 75, 80, 85, 90 and 95 weight percent. The percentage by weight of chromium in the stainless steel alloy may be any one of the following values or within a range of any two of the following values: 5, 10, 15, 20, 25 and 30 weight percent. The maximum percentage by weight of carbon in the stainless steel alloy may be any one of the following values or within a range of any two of the following values: 0.0, 0.2, 0.4, 0.6, 0.8, 1.0 and 1.2 weight percent. Other elements may be included in a stainless steel alloy to enhance corrosion resistance or other characteristics. Non-limiting examples include nickel, molybdenum, titanium, aluminum, niobium, copper, vanadium, nitrogen, sulfur, phosphorus and selenium. For example, 316 stainless steel, which includes molybdenum, nickel and manganese and other traces in addition to the major elements of iron, chromium and carbon, can be used in one or more embodiments.

Water contact angle can be used to characterize a surface as hydrophilic or hydrophobic. Hydrophilicity may mean a tendency for a surface to be wetted by water. Hydrophobicity may mean a tendency for a surface to repel water. The contact angle may be the angle where a liquid-vapor interface meets a solid surface. The contact angle can be used to quantify the wettability of a solid surface (e.g., a stainless steel alloy surface) by a liquid (e.g., water) via the Young equation:

$$\gamma_{SG}-\gamma_{SL}-Y_{LG}\cos\theta_c=0 \quad (1)$$

where $\gamma_{SG}$ is the solid-vapor interfacial energy, $\gamma_{SL}$ is the solid-liquid interfacial energy, $\gamma_{LG}$ is the liquid-vapor interfacial energy (e.g., the surface tension), and $\theta_c$ is the contact angle. FIG. 1 is a schematic side view of a water droplet 10 on a surface 12 of a solid 14. FIG. 1 depicts the quantities $\gamma_{SG}$, $\gamma_{SL}$ and $\gamma_{LG}$ in the Young equation as arrows 16, 18 and 20, respectively. The contact angle $\theta_c$ 22 is the angle between the $\gamma_{SL}$ arrow 18 and the $\gamma_{LG}$ arrow 20.

Figure 2:
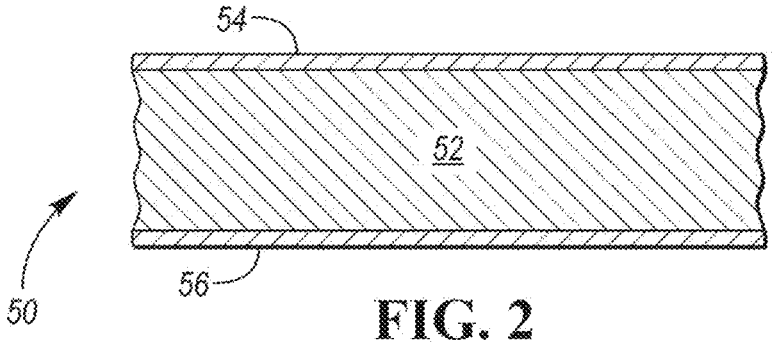
FIG. 2 is a cross section view of a metal material sheet according to one embodiment.

In one embodiment, the metal material being treated to impart hydrophobicity is formed as a sheet, although other forms of metal material, such as angles, beams, tees and channels, may be treated according to one or more embodiments. FIG. 2 is a cross section view of metal material sheet 50 according to one embodiment. Metal material sheet 50, which may be formed of a stainless steel alloy, may include a bulk portion 52 and opposing surface portions 54 and 56. Each surface portion 54 and 56 may have a nominal thickness independently selected from any one of the following values or within a range of any two of the following values: 20 nm, 100 nm, 500 nm, 1,000 nm, 5,000 nm and 10,000 nm. The bulk portion 52 may have a nominal thickness selected from any gauge or within a range of any two gauges.

In a first step of a treatment method according to one embodiment, a surface portion of a stainless steel alloy is partially or completely oxidized to form M-O bonds (where M is a metal) within the surface portion. At least a portion of the M atoms within the surface portion (defined by its nominal thickness) may be oxidized. The at least a portion of oxidized M atoms may be any one of the following or within a range of any two of the following values: 50, 60, 70, 80, 90, 95, 99 and 100%. The oxidized metal atoms M may be chromium and/or iron metal elements (and possibly other metal elements, e.g., nickel, manganese, etc.). X-Ray photoelectron spectroscopy (XPS) can be used to perform an analysis of the concentrations in the surface portion. Another testing method for performing surface portion elemental analysis is inductively coupled plasma-optical emission spectrometry (ICP-OES). The ratio of oxidized chromium atoms to iron atoms may be any one of the following or within a range of any two of the following ratios: 1:9, 1:8, 1:7, 1:6, 1:5, 1:4, 1:3 and 1:2.

In one embodiment, the surface portion may be oxidized by heating the stainless steel alloy at an elevated temperature for a period of time in an environment. The environment may be air (with or without moisture) at atmospheric pressure in an oven, although the pressure may be increased depending on the application. The elevated temperature may be any one of the following or within a range of any two of the following values: 600, 700, 800, 900 and 1,000° C. The period of time may be any one of the following values or within a range of any two of the following values: 0, 30, 60, 90 and 120 minutes.

In another embodiment, the surface portion may be oxidized by immersing the stainless steel alloy material in an aqueous bath of concentrated nitric acid at a temperature for a period of time. In one embodiment, the concentration of the nitric acid may be any one of the following or within a range of any two of the following values: 1, 2 and 3 M (mol/L). The immersion time may be any one of the following or within a range of any two of the following values: 2, 3, 4, 5, 6, 7, 8, 9 and 10 hours. The temperature may be any one of the following or within a range of any two of the following values: 0, 20, 40, 60, 80, 100 and 120° C.

Alternatively, the surface portion may be oxidized by immersing the stainless steel alloy material in a bath of an aqueous bath of concentrated sulfuric acid at a temperature for a period of time. In one embodiment, the concentration of sulfuric acid may be any one of the following or within a range of any two of the following values: 40, 50, 60, 70, 80, 90 and 98%. The immersion time may be any one of the following or within a range of any two of the following values: 2, 3, 4, 5, 6, 7, 8, 9 and 10 hours. The temperature may be any one of the following or within a range of any two of the following values: 0, 20, 40, 60, 80, 100 and 120° C.

In one embodiment, the surface portion may be oxidized by placing the stainless steel alloy in a plasma chamber and treating it with oxygen plasma created by utilizing a plasma generator. The plasma generator charges the oxygen ions with freely moving electrons in both the negative and positive states. The stainless steel alloy can be treated in the plasma chamber for a period of time of one of the following or within a range of any two of the following values: 20 seconds, 40 seconds, 1 minute, 2 minutes and 3 minutes. The plasma chamber can be under a vacuum or atmospheric pressure.

In a second step of the treatment method according to one embodiment, the oxidized surface portion of the first step is chemically doped by fluorine. A fluorine-containing salt in an organic solvent may be used as the fluorination agent for the fluorine chemical doping step. The concentration of the fluorine-containing salt in the organic solvent may be any one of the following or within a range of any two of the following concentrations: 0.1, 0.5, 1, 2 and 3 mol/L (depending on the solubility of the salt in certain organic solvents). Non-limiting examples of fluorine containing salts include lithium tetrafluoroborate ($LiBF_4$), lithium hexafluorophosphate ($LiBF_6$) and sodium tetrafluoroborate ($NaBF_4$). Non-limiting examples of organic solvents include acetonitrile ($CH_3CN$) (ACN), cyclohexanone $(CH_2)_5CO$ (CHN), methanol ($CH_3OH$) (MeOH), toluene ($C_7H_8$) and dimethyl sulfoxide ($(CH_3)_2SO$) (DMSO).

In one embodiment, the selectively oxidized surface portion of the stainless steel alloy is immersed in a bath of a fluorination agent at a temperature during a period of time. For instance, the fluorination agent is $LiBF_4$ in ACN. The temperature may be any one of the following or within a range of any two of the following concentrations: 25, 30, 40, 50, 60, 70 and 80° C. The immersion time may be any one of the following or within a range of any two of the following values: 20, 40, 60, 80, 100, 120, 140, 160, 180 and 200 hours.

After the fluorine chemical doping step, the surface portion includes a concentration of fluorine, oxygen and metal atoms. The fluorine concentration percentage in the surface portion may be any one of the following or within a range of any two of the following concentration percentages: 0, 2, 4, 6, 8, and 10 percent by mol. The oxygen concentration percentage in the surface portion may be any one of the following or within a range of any two of the following concentration percentages: 50, 52, 54, 56, 58, and 60 percent by mol. The metal atom concentration percentage may be any one of the following or within a range of any two of the following concentration percentages: 40, 42, 44, 46, 48, and 50 percent by mol. X-Ray photoelectron spectroscopy (XPS) can be used to perform an analysis of the concentrations in the surface portion. Another testing method for performing surface portion elemental analysis is inductively coupled plasma-optical emission spectrometry (ICP-OES).

Figure 3A:
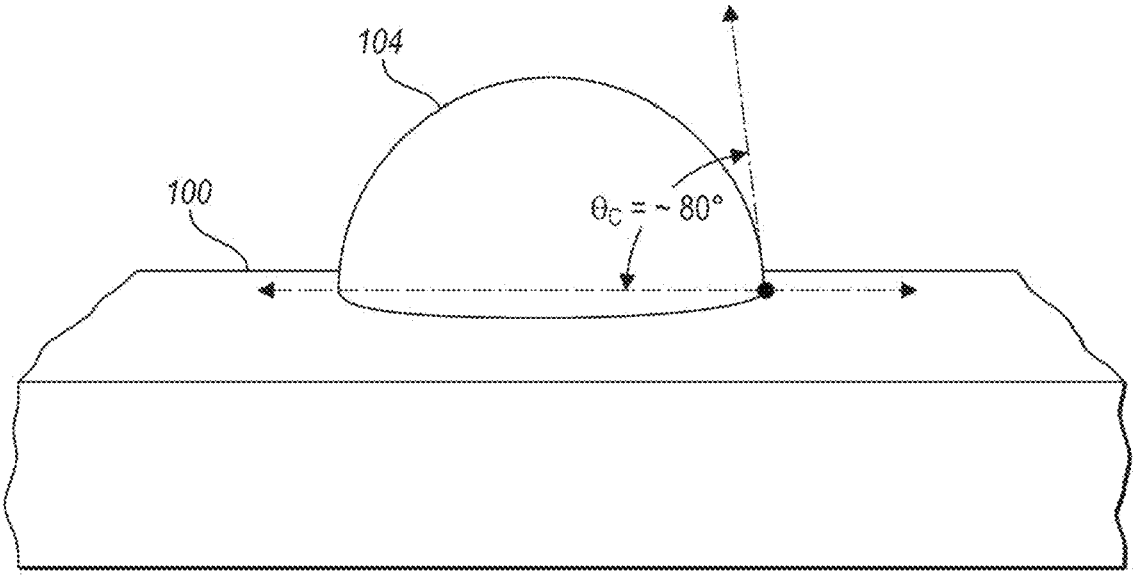
FIGS. 3*a* and 3*b* depict perspective views of stainless steel surfaces supporting water droplets depicting water contact angles with the stainless steel surfaces.
Figure 3B:
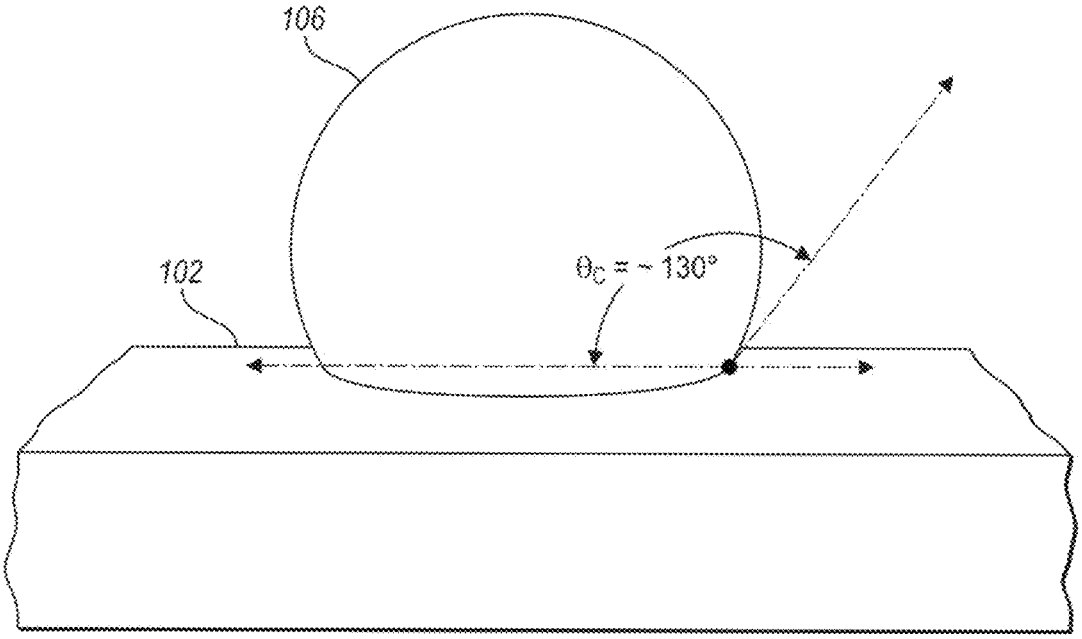

FIGS. 3*a* and 3*b* depict perspective views of stainless steel surfaces 100 and 102, respectively. Surface 100 is a surface that is cleaned to remove residual organic species from a surface portion of the stainless steel. In one example, acetone, water and isopropyl alcohol (IPA) can be used to remove substantially all the residual organic species. Water droplet 104 is applied to cleaned surface 100. Surface 102 is the surface after it is cleaned and treated using the two-step method identified above (e.g., oxidizing and fluorine doping the surface portion). Water droplet 106 is applied to cleaned and treated surface 102.

As can be seen in FIG. 3*a*, water droplet 104 on the cleaned (but not treated) surface 100 has a contact angle of about 80°. As can be seen in FIG. 3*b*, water droplet 106 on the cleaned and treated surface 102 has a contact angle of about 130°. In one embodiment, if a water contact angle is less than 90°, then the solid surface is considered hydrophilic, and if the water contact angle is greater than or equal to 90°, then the solid surface is considered hydrophobic. In other embodiments, if the water contact angle is less than 85°, then the solid surface is considered hydrophilic, and if the water contact angle is greater than or equal to 85°, then the solid surface is considered hydrophobic. Accordingly, as shown in FIGS. 3*a* and 3*b*, stainless steel surface 100 is hydrophilic and stainless steel surface 102 is hydrophobic by virtue of the treatment method.

Figure 4A:
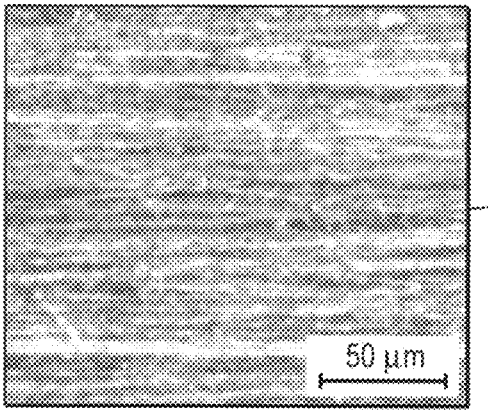
FIGS. 4*a*, 4*b* and 4*c* depict topological views of the surface morphology of a stainless steel alloy according to one embodiment.
Figure 4C:
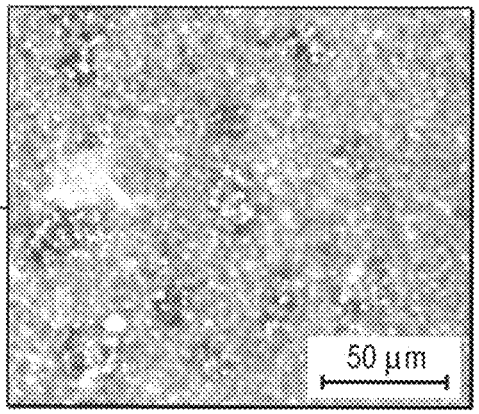
Figure 4B:
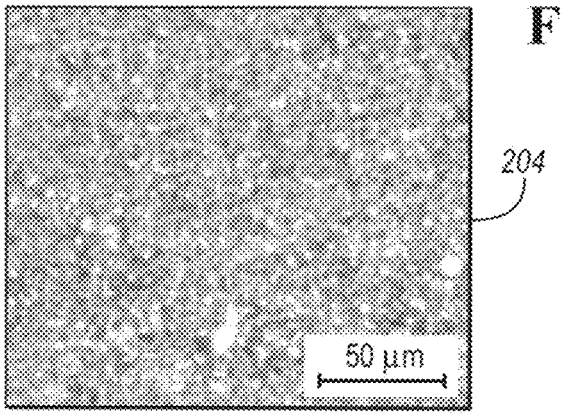

FIGS. 4*a*, 4*b* and 4*c* depict topological views of the surface morphology of a stainless steel material according to an embodiment. FIG. 4*a* depicts a surface morphology 200 of the stainless steel material that has been cleaned to remove residual oil from a surface portion of the stainless steel. Surface morphology 200 has a surface roughness of any one of the following or within a range of any two of the following surface roughness values: 20 nm, 100 nm, 500 nm, 1 μm, 5 μm, 10 μm and 20 μm. In one or more embodiments, the surface morphology 200 is hydrophilic. FIG. 4*b* depicts a surface morphology 202 of the stainless steel material after it has been oxidized using one of the embodiments. Surface morphology 202 has a surface roughness of any one of the following or within a range of any two of the following surface roughness values: 40 nm, 100 nm, 500 nm, 1 μm, 25 μm, 50 μm, 75 μm and 100 μm. As shown in FIGS. 4*a* and 4*b*, the oxidation step increases the surface roughness of the stainless steel material. In one or more embodiments, while the surface roughness is increased, the hydrophilicity increases mostly due to the metal oxide surface, less due to the roughness. FIG. 4*c* depicts a surface morphology 204 of the stainless steel material after surface morphology 202 has been doped with fluorine according to an embodiment. Surface morphology 204 has a surface roughness of any one of the following or within a range of any two of the following surface roughness values: 40 nm, 100 nm, 500 nm, 1 μm, 25 μm, 50 μm, 75 μm and 100 μm. In one embodiment, the surface roughness does not substantially change by virtue of the fluorination step. In another embodiment, as shown in FIGS. 4*b* and 4*c*, the fluorine doping step increases the surface roughness of the stainless steel material. The rough sample before fluorination step is hydrophilic, and after fluorination step it is hydrophobic. In one or more embodiments, the fluorine doping step increases the water contact angle such that the stainless steel material changes from hydrophilic to hydrophobic. Although not wanting to be bound to one theory, the hydrophobicity largely results from the contribution of fluorine bonds with metal (and to a lesser extent fluorine bonds with oxygen).

Figure 5C:
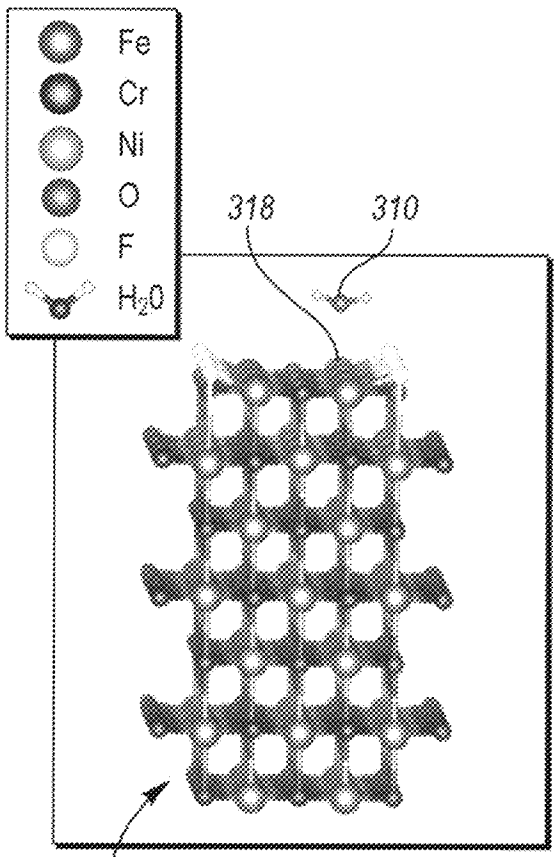
FIGS. 5*a*, 5*b*, and 5*c* depict molecular models of different metal material surface portions interacting with water molecules.
Figure 5B:
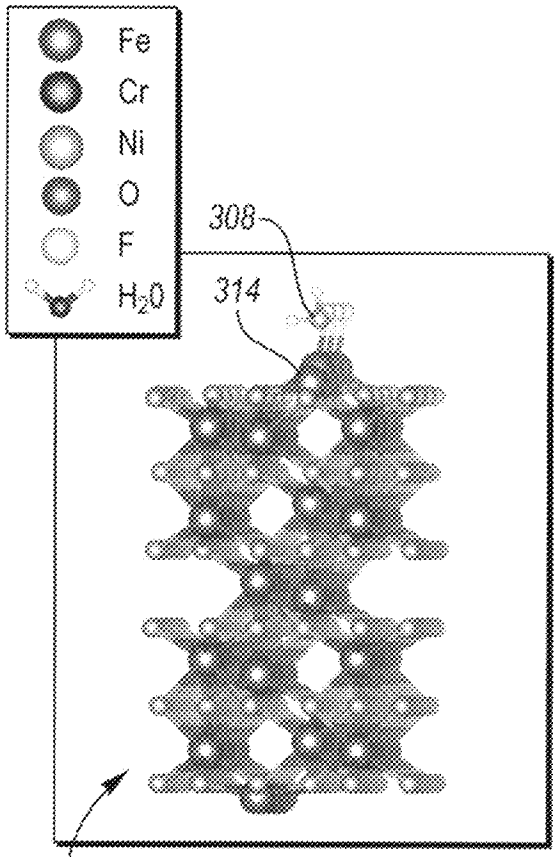
Figure 5A:
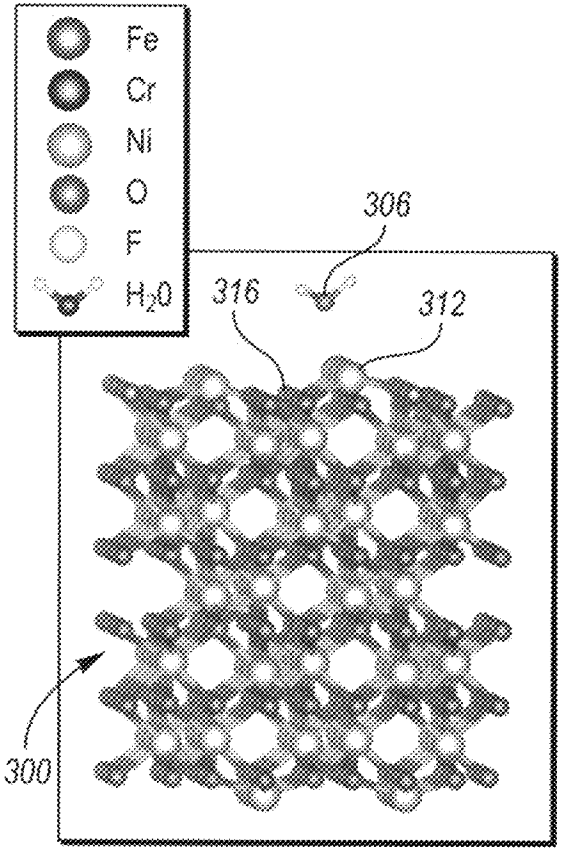

FIGS. 5*a*, 5*b*, and 5*c* depict molecular models of different metal material surface portions 300, 302 and 304 interacting with water molecules 306, 308, and 310, respectively. These molecular models were prepared using a density function theory (DFT) slab model using a generalized gradient approximation (GGA) scheme in the Vienna Ab Initio Simulation Package (VASP). Surface portion 300 is a fluorine doped (0001) $Fe_2O_3$. In FIG. 5*a*, water molecule 306 binds to an iron site 312 on surface portion 300. Surface portion 302 is a fluorine adsorbed (0001) $Cr_2O_3$. In FIG. 5*b*, water molecule 308 binds to a chromium site 314 on surface portion 302. As shown in FIG. 5*a*, fluorine substitution on an oxygen site 316 may be favorable in a (0001) $Fe_2O_3$ surface facet. In FIG. 5*b*, fluorine adsorbs on chromium site 314 more favorably than substituting oxygen in a (0001) $Cr_2O_3$ surface facet. Surface portion 304 is a fluorine doped (100) NiO. In FIG. 5*c*, water molecule 310 binds to a nickel site 318 on surface portion 304.

The following equations can used in the simulation tool to calculate the binding energy difference with or without the presence of fluorine on the oxide surface portions 300, 302, and 304.

$$\Delta E_{Rel,Binding,H_2O}=\Delta E_{Binding,H_2O,Flourinated}-\Delta E_{Binding,H_2O,pristine} \quad (2)$$

$$\text{where, } E_{Binding,H_2O,i}=E_{0,Final}-(E_{0,slab}+\Delta\mu_{H_2O}) \quad (3)$$

where $\Delta E_{Binding,H_2O}$ is the binding energy difference with or without the presence of fluorine on the oxide surface portions 300, 302 and 304. For each case, $\Delta E_{Rel,Binding,H_2O}$ can be obtained by calculating the following quantities from DFT: $E_{0,Final}$ is the internal energy of the final relaxed structure of both oxide and water, $E_{0,slab}$ is the internal energy of the oxide structure (without water), and $\Delta\mu_{H_2O}$ is the chemical potential of water. Using this equation, the binding energy was calculated for (0001) $Fe_2O_3$, (0001) $Cr_2O_3$ and (100) NiO with or without the presence of fluorine on the oxide surface portions 300, 302 and 304. The calculated values of relative binding energy difference with or without fluorine are −0.113 eV, +0.441 eV, and +0.419 eV. These values show that oxides such as (0001) $Cr_2O_3$ and (100) NiO show higher binding $H_2O$ energies than (0001) $Fe_2O_3$ (by >0.4 eV per site) with the presence of fluorine in the surface portions. This difference supports that certain oxides such as (0001) $Cr_2O_3$ and (100) NiO have increased hydrophobicity.

Chromium and/or nickel may migrate to the surface portion of stainless steel during the manufacturing process. The chromium concentration percentage in the surface portion may be any one of the following or within a range of any two of the following concentration percentage: 0, 2.5, 5 and 7.5 percent by mol. The nickel concentration percentage in the surface portion may be any one of the following or within a range of any two of the following concentration percentage: 0.5, 1, 1.5, 2 and 2.5 percent by mol. These concentrations may be higher than the concentrations of chromium and/or nickel in a bulk region of a stainless steel sheet. Upon performing the oxidation step according to one embodiment, the chromium and nickel form stable oxides such as $Cr_2O_3$ and NiO. Accordingly, it has been found that selecting a thickness of surface portion to obtain higher concentrations of stable oxides than in the bulk portion (e.g., 10, 20, 30, 40 or 50 percent higher or within a range of any two of these values) results in a fluorination step that increases hydrophobicity.

The following examples illustrate various embodiments. In a first example, at least one of the surface portions (thickness of 10 μm) of a stainless steel alloy sheet is cleaned of residual organic species using a combination of acetone, water and isopropyl alcohol (IPA). The at least one cleaned surface portion has a contact angle within a range of 80° to less than 90°, and accordingly, the at least one cleaned surface portion is hydrophilic. In an oxidizing step, at least one of the cleaned surface portions is oxidized at 1,000° C. for 2 hours in an oven to form at least one oxidized surface portion. In a fluorination step, the at least one oxidized surface portion is immersed in a bath of 1 M $LiBF_4$ in a cyclohexanone (CHN) solution for 8 hours at 50° C. to form at least one fluorinated surface portion. The contact angle of the at least one fluorinated surface portion is within a range of 120° to 130°. In this example, the two-step method makes the at least one surface portion adequately hydrophobic.

In a second example, at least one of the surface portions (thickness of 10 μm) of a stainless steel alloy sheet is cleaned of residual oil using acetone water. The at least one cleaned surface portion has a contact angle within a range of 80° to less than 90°, and accordingly, the at least one cleaned surface portion is hydrophilic. In an oxidizing step, at least one of the cleaned surface portions is oxidized at 500° C. for 2 hours in an oven to form at least one oxidized surface portion. In a fluorination step, the at least one oxidized surface portion is immersed in a bath of 1M $LiBF_4$ in a cyclohexanone (CHN) solution for 8 hours at 50° C. to form at least one surface portion treated with fluorine. The contact angle of the at least one surface portion treated with fluorine is within a range of 60° to less than 90°. In this example, the two-step method does not make the at least one surface portion hydrophobic according to a theory that the stainless steel surface is not sufficiently oxidized to form species that can react with the fluorine in the fluorinating step.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A method for treating a metal material comprising:

oxidizing an untreated surface portion of the metal material to form an oxidized surface portion, the untreated surface portion having metal atoms, and the oxidizing step forming bonds between the metal atoms and oxygen atoms; and doping the oxidized surface portion with a liquid containing a fluorine-containing salt to form a fluorinated surface portion, the doping step forming bonds between fluorine atoms and at least a portion of the metal atoms and the oxygen atoms, and the fluorinated surface portion being hydrophobic.

2. The method of claim 1, wherein the metal material is a stainless steel alloy.

3. The method of claim 1, wherein the untreated surface portion has a thickness of 20 nm to 20 μm.

4. The method of claim 1, wherein the liquid is an organic solvent.

5. The method of claim 1, wherein the oxidizing step includes heating the untreated surface portion at an elevated temperature for a period of time.

6. The method of claim 5, wherein the elevated temperature is 700 to 1,000° C. and the period of time is 1 to 2 hours.

7. The method of claim 1, wherein the oxidizing step includes immersing the metal material in an aqueous bath of an acid at a temperature for a period of time.

8. The method of claim 7, wherein the acid is nitric or sulfuric acid.

9. The method of claim 7, wherein the temperature is 0 to 120° C. and the period of time is 2 to 10 hours.

10. The method of claim 1, wherein the oxidizing step includes oxygen plasma treating the untreated surface portion to form the oxidized surface portion.

11. The method of claim 1, wherein the fluorine-containing salt is lithium tetrafluoroborate ($LiBF_4$), lithium hexafluorophosphate ($LiBF_6$), sodium tetrafluoroborate ($NaBF_4$), or a combination thereof.

12. A method for treating a metal material comprising:

selecting a depth of an untreated surface portion of the metal material based on a threshold concentration of a metal material combination including chromium atoms and nickel atoms in the untreated surface portion;

oxidizing the untreated surface portion to form an oxidized surface portion by forming bonds between at least a portion of the chromium atoms and the nickel atoms in the metal material combination and oxygen atoms; and doping the oxidized surface portion with a liquid containing a fluorine-containing salt to form a fluorinated surface portion, the doping step forming bonds between fluorine atoms and at least a portion of the chromium atoms and the nickel atoms in the metal material combination and the oxygen atoms, and the fluorinated surface portion being hydrophobic.

13. The method of claim 12, wherein a contact angle of the fluorinated surface portion is greater than or equal to 90°.

14. The method of claim 12, wherein a contact angle of the oxidized surface portion is less than 90°.

15. The method of claim 12, wherein the metal material includes a bulk region, and a concentration of the chromium atoms and/or the nickel atoms are higher in the untreated surface region than the bulk region.

16. The method of claim 12, wherein the liquid includes an organic solvent.

17. The method of claim 12, wherein the fluorine-containing salt is $LiBF_4$.

18. A method for treating a metal material comprising:

selecting a depth of an untreated surface portion of the metal material based on a threshold concentration of a metal material combination including chromium atoms and nickel atoms in the untreated surface portion, the metal material combination further includes molybdenum and/or manganese;

oxidizing the untreated surface portion to form an oxidized surface portion by forming bonds between at least a portion of the chromium atoms and the nickel atoms in the metal material combination and oxygen atoms; and doping the oxidized surface portion with a liquid containing a fluorine-containing salt to form a fluorinated surface portion, the doping step forming bonds between fluorine atoms and at least a portion of the chromium atoms and the nickel atoms in the metal material combination and the oxygen atoms, and the fluorinated surface portion being hydrophobic.

19. The method of claim 18, wherein the liquid includes an organic solvent.

20. The method of claim 18, wherein the fluorine-containing salt is $LiBF_4$.

* * * * *